US005121163A

United States Patent [19]

Muramatsu et al.

[11] Patent Number: 5,121,163

[45] Date of Patent: Jun. 9, 1992

[54] TRANSFER TYPE IMAGE FORMING APPARATUS WITH TONER CONTENT DETECTION

[75] Inventors: Masanori Muramatsu, Kawasaki; Yoshihiro Murasawa, Sagamihara; Yuji Hasegawa, Tokyo, all of Japan

[73] Assignee: Canon Kabushiki Kaisha, Tokyo, Japan

[21] Appl. No.: 560,770

[22] Filed: Jul. 31, 1990

[30] Foreign Application Priority Data

Jul. 31, 1989 [JP] Japan ..... 1-196658

[51] Int. Cl.[5] ..... G03G 21/00

[52] U.S. Cl. ..... 355/246

[58] Field of Search ..... 355/246, 204, 214, 208, 355/271, 274, 326, 327

[56] References Cited

U.S. PATENT DOCUMENTS

| | | | |
|---|---|---|---|
| 3,872,825 | 3/1975 | Davidson | 118/4 |
| 4,277,162 | 7/1981 | Kasahara et al. | 355/208 |
| 4,646,679 | 3/1987 | Ohno et al. | 118/691 |
| 4,712,906 | 12/1987 | Bothner et al. | 355/271 |
| 4,766,463 | 8/1988 | Watanuki et al. | 355/272 |
| 4,864,367 | 9/1989 | Nakahara et al. | 355/274 X |
| 4,894,685 | 1/1990 | Shoji | 355/246 |
| 4,965,634 | 10/1990 | Bando | 355/208 |

FOREIGN PATENT DOCUMENTS

| | | | |
|---|---|---|---|
| 0339309 | 11/1989 | European Pat. Off. | 355/326 |
| 0136065 | 6/1968 | Japan | 355/326 |
| 0033734 | 3/1977 | Japan | 355/246 |
| 0080865 | 5/1985 | Japan | 355/327 |
| 0081666 | 4/1987 | Japan | 355/246 |
| 0131152 | 6/1988 | Japan | 355/246 |

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus includes a movable image bearing member; a device for forming an image on the image bearing member, the image forming device including a developing device for forming a toner image on the image bearing member; a transfer device for transferring a toner image onto a transfer material, the transfer device including transfer material carrying member for carrying the transfer material to an image transfer station; a toner content detector for detecting toner content, the detector detecting toner content using the toner deposited on the image bearing member by the developing device; and a controller for controlling the toner content in the developing device in accordance with an output of the detector; wherein the toner for the detection is deposited on such a portion of the image bearing member as to be out of contact from the transfer material carrying member.

46 Claims, 15 Drawing Sheets

TRANSFER TYPE IMAGE FORMING APPARATUS WITH TONER CONTENT DETECTION

FIELD OF THE INVENTION AND RELATED ART

The present invention relates to an image forming apparatus such as an electrophotographic copying machine, more particularly to an image forming apparatus such as a color copying machine of an image overlaying transfer type.

Many developing devices used with a dry type electrophotographic machine or an electrostatic copying machine, use a developer containing carrier and toner particles. The weight ratio between the toner and carrier particles of the developer is important from the standpoint of the development performance. Particularly in the case of a full-color copying apparatus wherein a full-color image is provided by superposing on a transfer material plural toner images provided by the plural developing devices, the weight ratio is important in order to assure the reproducibility of the color. When the ratio (which will hereinafter be called toner content) is small, the image density is small (thin image). On the contrary, if the toner content is too large, the image density becomes too high together with undesirable production of the foggy background.

Therefore, in order to provide continuously good color images, it is desired that the toner content of the developer is maintained at a proper level. Usually, therefore, the toner content of the developer is detected, and in response to the detection, only the toner particles are supplied to the developing device. Conventional toner content detecting methods include:

1. The toner content is detected using the fact that optical reflection of the mixture of the toner and carrier particles in the developing device is dependent on the toner content:

2. The toner density is detected by the fact that the magnetic permeability of the mixture of the toner and carrier particles in the developing device is dependent on the toner content: and 3. A test toner image is produced on the image bearing member, and the toner content is detected by the optical reflection index of the toner image.

The above method 1 requires the use of light having a wave length resulting in a significant difference in the refraction indexes by the toner and carrier particles. The carrier particles may be iron (Fe), ferrite or the like which absorb the light of any wavelength. Therefore, the light must be selected so that it has a wavelength having a high reflection index relative to the coloring material of the toner or the resin component. However, in the case of the toner particles using carbon black which is widely used as black coloring material in the two component developer, the toner particles absorb light of any wavelength, so that all the light is absorbed by both the toner and carrier particles. Therefore, the toner content is not detected by the method 1.

The method 2 involves the problem that the toner content is not always properly detected, because the bulk density of the toner and carrier particles influential to the change in the magnetic permeability is significantly dependent on the rest period of the developing device, the stirring period and amount of electric charge.

It follows that the third method is frequently used to detect the black toner content in the two component developer, when the coloring material of the toner is carbon black.

However, when the method 3 is used in the overlaying image transfer system wherein plural toner images are transferred superposedly on the transfer material as in a color copying machine, means for moving the transfer drum (transfer material carrying means) away from the image bearing member is required in order to prevent the test toner image from being transferred onto the transfer material carrying sheet of the transfer drum. This results in the complicated and bulky structure of the transfer device with the increase of the manufacturing cost. In addition, since the transfer drum is moved away from the image bearing member each time the toner content is to be detected, the throughput decreases.

SUMMARY OF THE INVENTION

Accordingly, it is a principal object of the present invention to provide an image forming apparatus by which good images can be provided stably.

It is another object of the present invention to provide an image forming apparatus in which the toner for the detection of the toner content is prevented from being deposited onto the transfer material carrying means such as an image transfer drum.

It is a further object of the present invention to provide an image forming apparatus which does not require means for providing a space between the transfer drum and the image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 10:
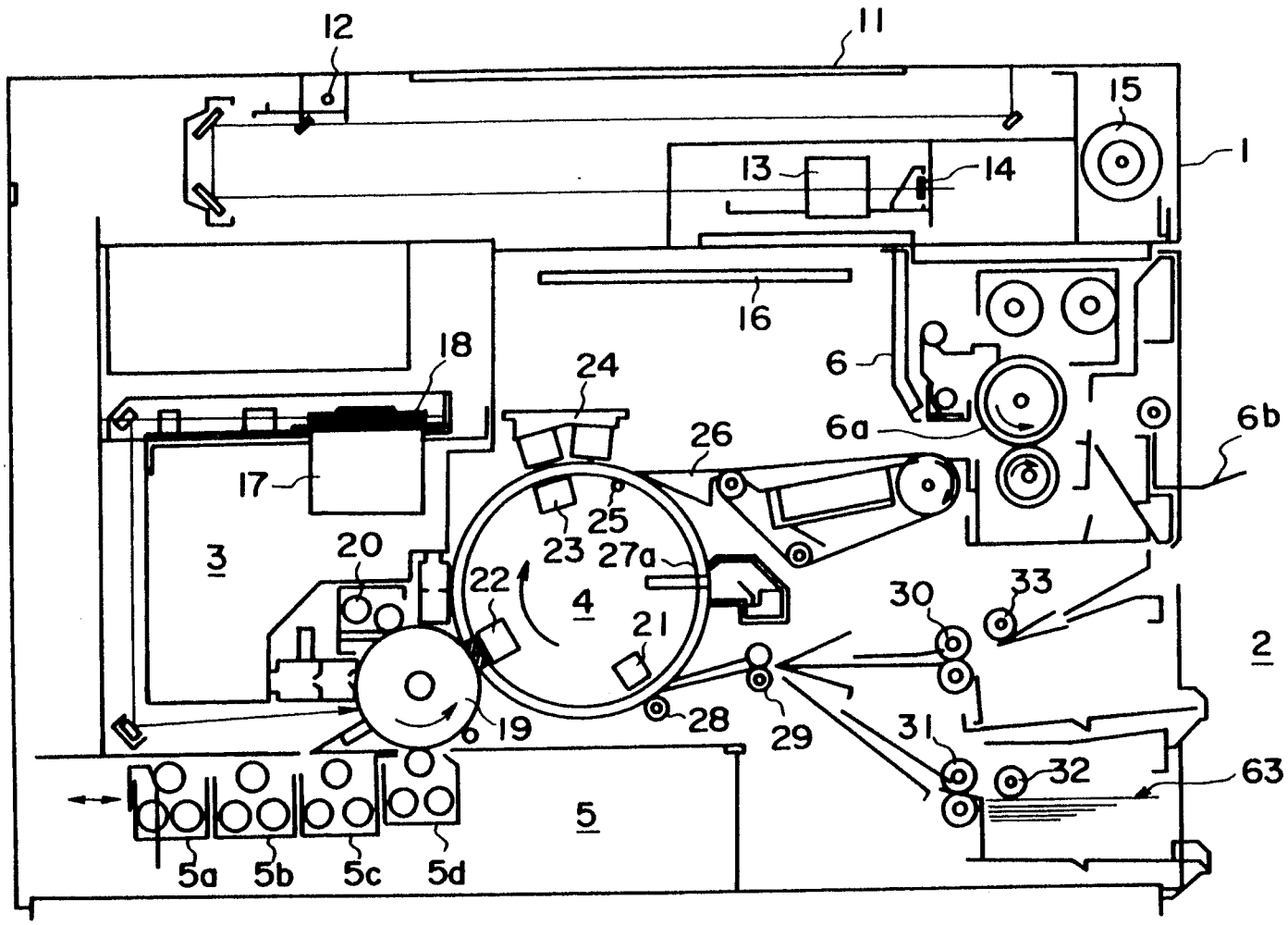
FIG. 10 is a sectional view of a color copying apparatus according to an embodiment of the present invention.

Referring first to FIG. 10, there is shown in cross-section the structure of a color copying apparatus according to an embodiment of the present invention. An image reading station 1 comprises an original supporting platen glass 11, an original illuminating lamp 12, an image lens 13, an image pickup element (CCD or the like (charge coupled device)) 14 and optical system driving motor 15.

A sheet feeding station comprises sheet feeding rollers 30 and 31, and pick-up rollers 32 and 33, and it feeds the transfer sheet (transfer material) 63 in accordance with the driving instructions produced by a controller 16.

An image forming station 3 comprises a scanner motor 17, a polygonal mirror 18, a photosensitive drum (image bearing member) 19 and a cleaner 20. It produces an electrostatic latent image on the photosensitive drum 19 by projecting a laser beam from a laser source in accordance with an image signal provided by the controller 16 as a result of processing the outputs of the image pickup element 14.

An image transfer device (means) 4 comprises an attraction charger 21, an image transfer charger 22, a separation charger 23, a high voltage unit 24, an inside abutment roller 25, a separation transfer drum 27*a* including a transfer material carrying sheet (made of dielectric material) 27 (see FIG. 1A), an attraction roller 28 and a registration roller 29. The transfer sheet 63 is fed by the feeding roller 30 or 31 to the registration roller 29 so that a predetermined degree of loop is formed by the transfer sheets 63. The registration roller 29 feeds the transfer sheet 63 in such timing that the leading edge of the transfer sheet is aligned with the leading edge of the image on the photosensitive drum 19. The transfer sheet 63 fed by the registration roller 29 is electrostatically attracted on the transfer material carrying sheet 27 by the operations of the attraction roller 28 and the attraction charger 21. The transfer charger 22 transfers onto the transfer sheet 63 the toner image formed on the photosensitive drum 19. The separation charger 23 functions as a charge removing discharger to electrically discharge the transfer sheet 63 to reduce the attraction between the transfer sheet 63 and the transfer material carrying sheet 27.

The controller 16 controls the timing of feeding the transfer sheet 63 to be sequentially attracted on the transfer material carrying sheet 27, on the basis of the position, relative to the photosensitive drum 19, of the developing devices 5*a*, 5*b*, 5*c* and 5*d* of the developing device 5 driven by the motor, and on the basis of the size of the selected transfer sheet, by which plural transfer sheets 63 are attracted on the transfer material carrying sheet 27 at predetermined intervals, and the sheet attraction timing of the subsequent transfer sheets 63 on the transfer material carrying sheet 27.

The description will be made as to the attraction and separation action for the transfer sheet 63 relative to the transfer material carrying sheet 27. The attraction charger 21 produces corona discharge having a polarity opposite to that of the charged toner. The attraction roller 28 is a grounded conductive roller and functions as an opposite electrode for the attraction charger 21 and also as means for injecting the electric charge into the transfer sheet 63 to attract the transfer sheet 63 onto the transfer material carrying sheet 27.

At the position where the transfer charger 22 and the photosensitive drum 19 are faced to each other, the electric charge having the polarity opposite to the toner is supplied onto the backside of the transfer material carrying sheet 27, so that the first color image is transferred, and then, the developing devices 5*a*–5*d* are sequentially displaced. After the completion of the required number (of the colors) of the developing and image transfer operations, the attraction force between the transfer sheet 63 and the transfer material carrying sheet 27 is reduced by the pair of separation chargers 23 applying the AC corona discharge to electrically discharge them the separation chargers 23 sandwiching the transfer material carrying sheet 27.

Figure 1A:
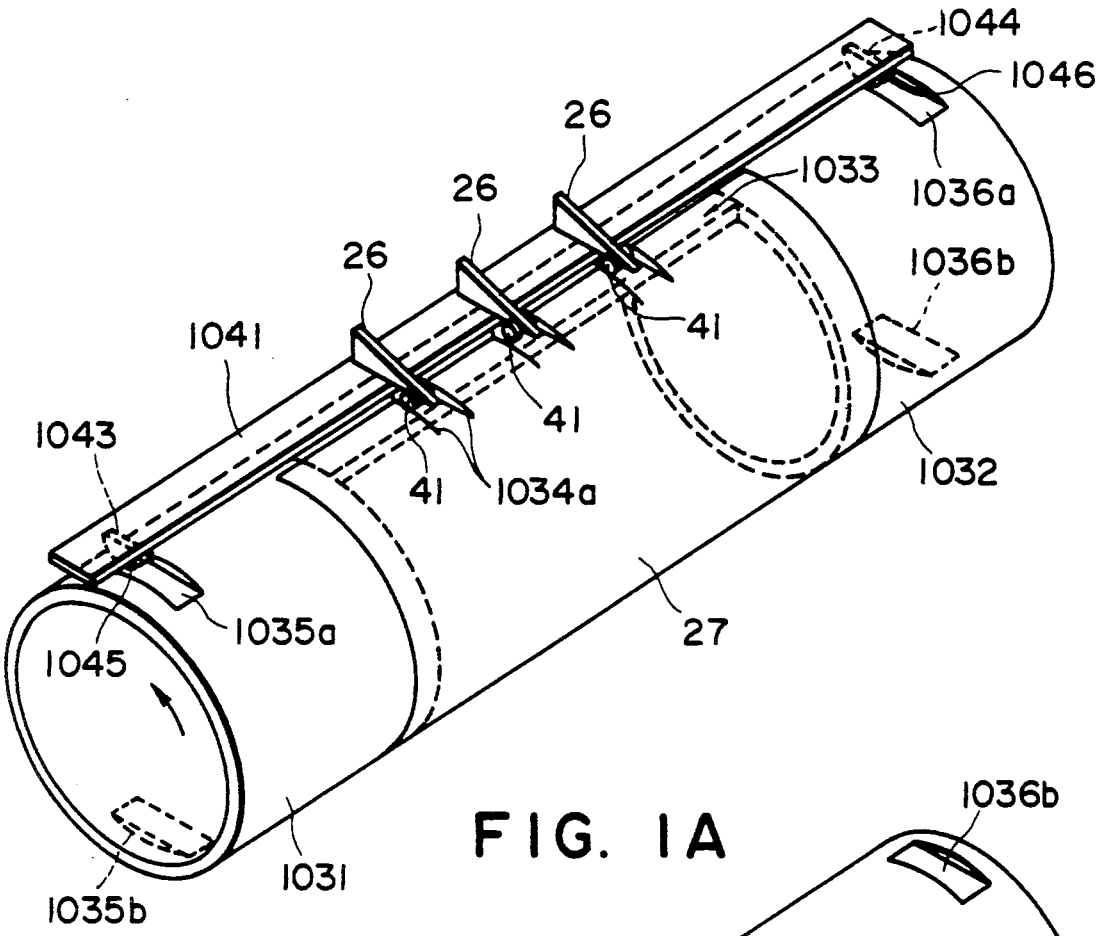
FIGS. 1A and 1B are perspective views of a transfer drum.
Figure 1B:
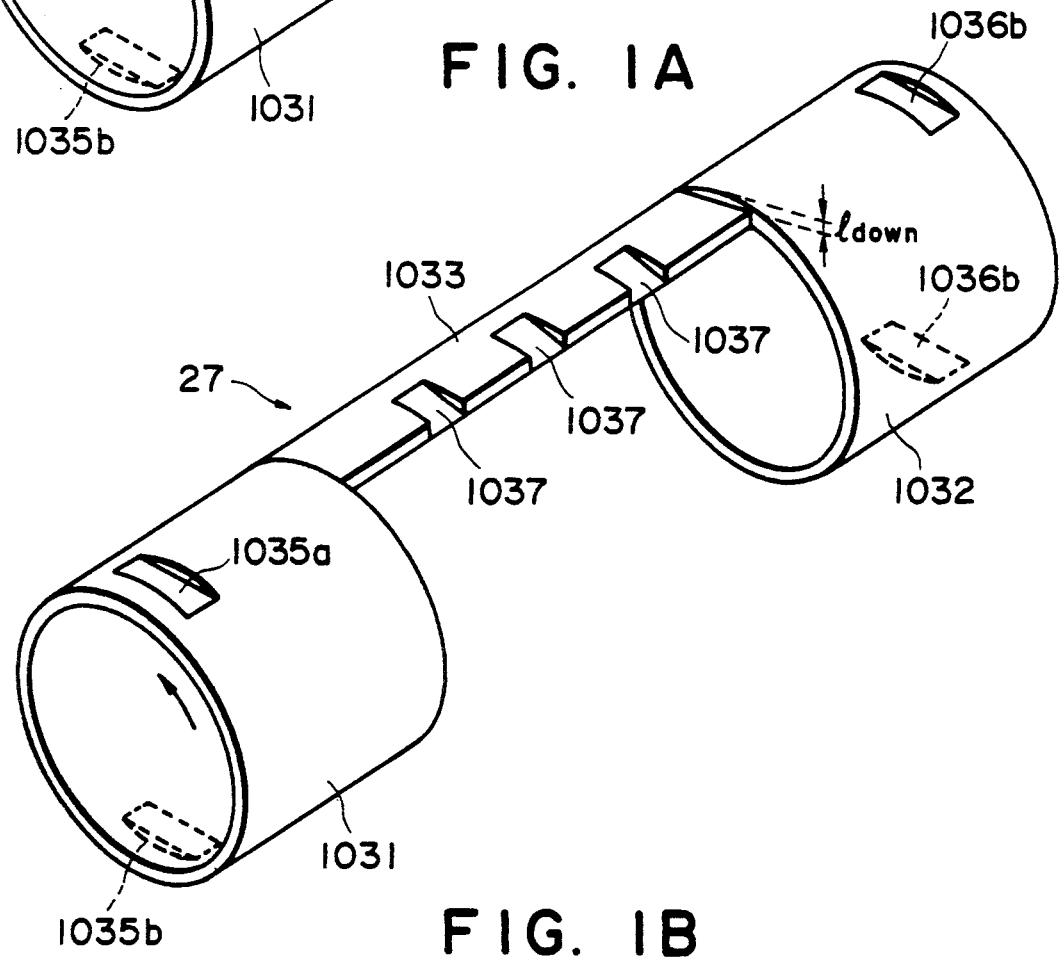

As shown in FIGS. 1A and 1B, the transfer drum 27*a* comprises a pair of cylindrical sleeves 1031 and 1032, which are connected by a plate-like connecting member 1033, and a transfer material carrying sheet 27 stretched to cover the opening defined by the sleeves 1031, 1032 and the connecting member 1033. Each of the outer peripheries of the sleeves 1031 and 1032 is provided with a diametrical pair of crescent guiding grooves 1035*a* and 1035*b*, or 1036*a* and 1036*b* The connecting member 1033 is provided with cut-away portions 1037 arranged in the longitudinal direction of the transfer drum 27*a*.

Plural separating pawls 26 are provided at the top side of a plate-like supporting member 1041 extended in the longitudinal direction of the transfer drum 27*a*. Each separating pawl 26 is provided with outside abutment rollers 41. At the bottom side of the supporting member 1041, abutment rollers 1045 and 1046 are mounted b bracket 1043 and 1044.

The description will be made as to the separating action for the transfer sheet 63 attracted on the transfer material carrying sheet 27. In the apparatus of this embodiment, the transfer material carrying sheet is large enough to support thereon two transfer sheets when the size of the used transfer sheets 63 is as small as one half of the circumferential length of the transfer material carrying sheet 27, as will be described in detail hereinafter. The attraction of the transfer sheet 63 with its leading edge adjacent the connecting member 1033 is called "A area attraction", and the attraction thereof at the position substantially diametrically opposite, is called "B area attraction". The separations of the transfer sheets 63 of the A area attraction and B area attraction are called "A area separation" and "B area separation", respectively.

A-area separation

Figure 11:
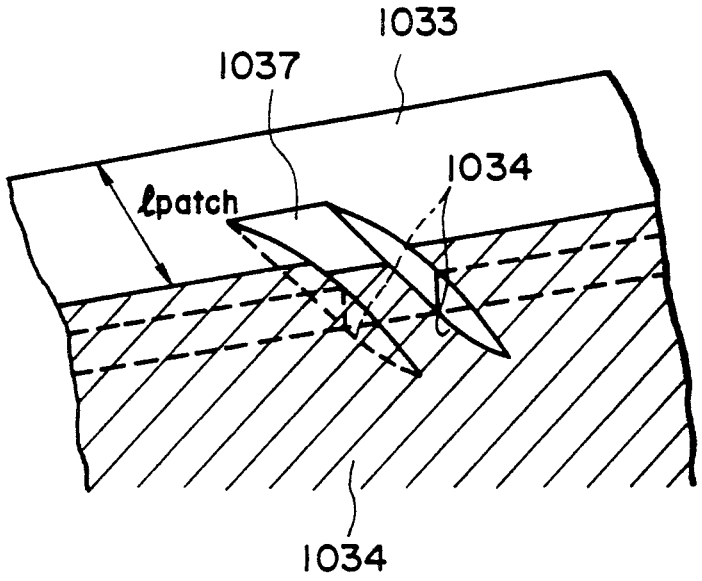
FIG. 11 is an enlarged perspective view of a connecting member of the transfer drum.

Referring to FIGS. 1A, 1B and 11, the transfer sheet 63 is attracted on the A area without overlap with the connecting member 1033 or the cut-away portions 1037 which correspond to that area of the photosensitive drum 19 which may have the toner image for detection of the toner content, that is, without overlapping with the portion of the transfer device 4 where the transfer material carrying sheet 27 is absent. When an unshown separation clutch is actuated, the abutment rollers 1045 and 1046 are abutted to the outer periphery of the sleeves 1031 and 1032, respectively, and are guided along the guiding grooves 1035*a* and 1036*a*, by which the tips of the separating pawls 26 approach the transfer material carrying sheet 27. Contemporaneously, the outside abutment rollers 41 advance along the cut-away portions 1037 to be abutted to the transfer material carrying sheet 27, and the separating pawls 26 wedge into the spaces between the transfer sheet 63 and the transfer material carrying sheet 27 to effect separation there between. At this time, the inside abutment roll 25 does not operate.

B-area separation

Figure 2:
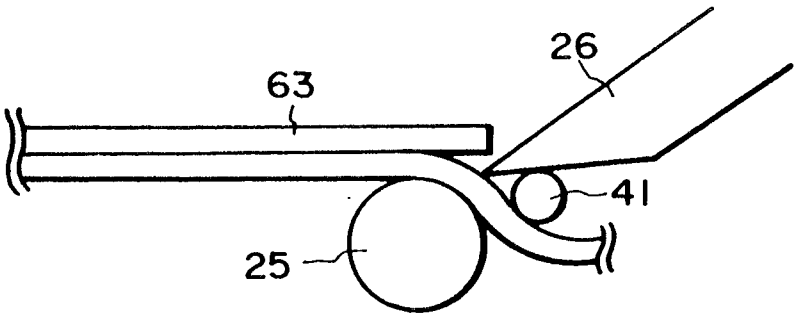
FIG. 2 is a sectional view of a major part illustrating separating action of a transfer sheet using a separation pawl.

As shown in FIG. 2, the inside abutment rollers 25 operate, and the outside abutment rollers 41 are urged to the guiding grooves 1035*b* and 1036*b* as shown in FIG. 1B, by which the curvature of the transfer material carrying sheet 27 is locally changed, and then, the separation pawls 26 wedge into the spaces between the leading edge of the transfer sheet 63 and the transfer material carrying sheet 27.

During the A area separation and B area separation, AC corona discharge is applied by the high voltage unit 24 in order to prevent the disturbance to the image on the transfer sheet 63 by separation discharge.

Figure 3:
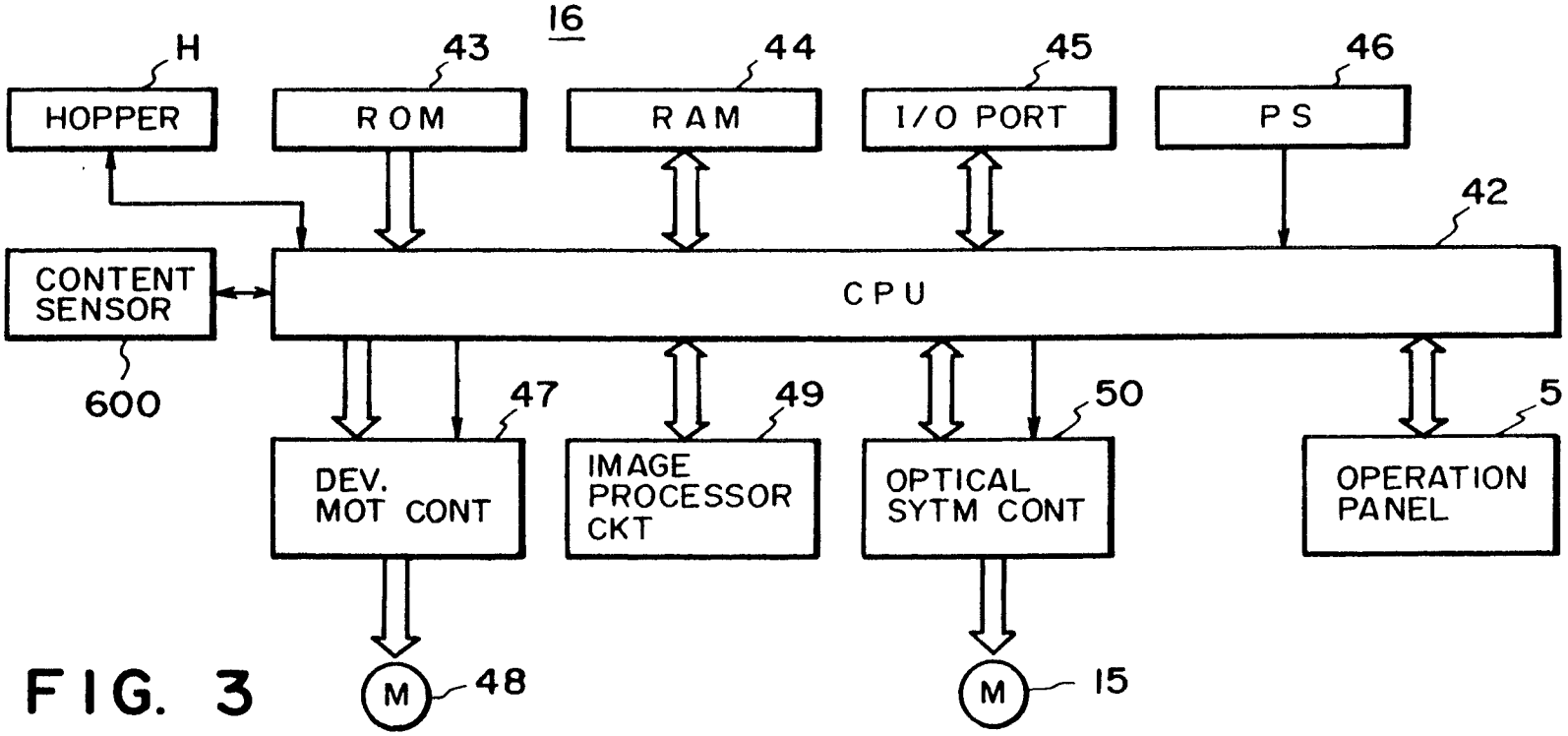
FIG. 3 is a block diagram illustrating structure of a controller.

FIG. 3 is a block diagram illustrating the structure of the controller 16, in which a CPU (central processing unit) 42 generally controls the sequential operations for the copying, in accordance with a control program stored in a ROM 43.

RAM 44 functions as a work memory for the CPU 42 and functions to store various flag information supplied from the operating panel 51. An I/O port 45 receives image data from the image pickup element 14, as shown in FIG. 10, and produces a synchronization control signal required for leading the image.

Figure 5:
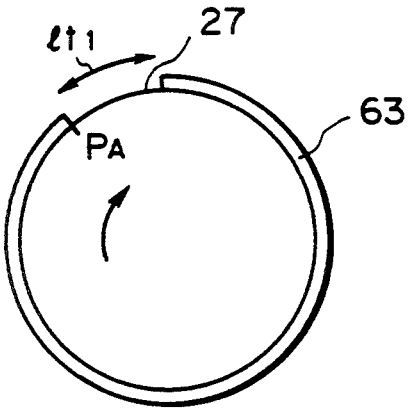
FIGS. 5 and 6 are sectional views illustrating the attraction of the transfer sheet on a transfer material carrying sheet.
Figure 6:
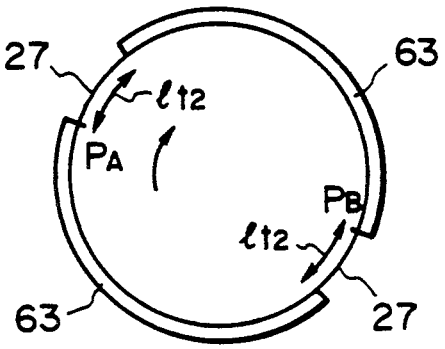

A position sensor (ITOP sensor) 46 serves to detect predetermined positions (leading edges $P_A$ and $P_B$ of the image) of the transfer material carrying sheet 27, as shown in FIGS. 5 and 6, and functions to supply to the CPU 42 image timing signals ITOP which determine image output timing, image transfer timing and development timing.

A developing device motor control 47 actuates a motor 48 to correctly position an unshown developing device carriage carrying the developing devices 5*a*–5*d* shown in FIG. 10. Where, for example, four color images are to be formed, and plural transfer sheets 63 (2 at maximum in this embodiment) are attracted on the transfer material carrying sheet 27, the CPU 42 determines the transfer sheet 63 feeding operation timing and the transfer sheet attraction timing such that the sheet feeding timing for the next transfer sheet 63 is delayed by one half the one full revolution of the transfer material carrying sheet 27. An image processing circuit 49 executes various processings to the image data supplied through the I/O port 45, such as color separation processing, to produce a video signal for modulating the laser source. The optical system motor controller 50 controls the optical system driving motor 15 for reciprocating the original scanning unit.

The image processing operation in the apparatus of FIG. 10 will be described. The transfer sheet 63 is fed out by the pick-up roller 32 or 33 and is conveyed to the registration roller 29 by the feeding rollers 30 and 31, by which the oblique conveyance of the transfer sheet 63 is corrected by formation of a predetermined degree of loop of the transfer sheet 63. The transfer sheet 63 is maintained at rest until the timing of being wrapped around the transfer drum 27*a* in association with the scanning operation by the optical system. Then, the registration roller 29 starts to rotate, by which the transfer sheet 63 is attracted on the transfer drum 27*a* by the operations of the attraction charger 21 and an attraction roller 28 which also functions as a opposite electrode. Substantially simultaneously, the optical system (original scanning unit) starts its scanning operation, and the image read by the image pickup element 14 is supplied to the image processing circuit 49 through the I/O port 45 shown in FIG. 3.

The image processing circuit 49 effects various image processing operations including color separation and color correction (known gamma correcting operation, for example). This image is then connected to a modulated laser beam and is deflected by a polygonal mirror 18. The photosensitive drum 19, uniformly charged, by an unshown charger is exposed to the laser beam so that an electrostatic latent image is formed.

The developing device 5*d* containing the magenta toner, the developing device 5*c* containing the cyan toner, the developing device 5*b* containing the yellow toner and the developing device 5*a* containing the black toner are moved in a horizontal plane at proper timing to develop the latent image.

The toner image thus formed on the photosensitive drum 19 is transferred onto the transfer sheet 63 by the transfer charger 22. The series of operations is repeated a required number of times (colors). Then, the attraction is reduced by the separation chargers 23, the transfer sheet is separated from the transfer material carrying sheet 27 by either of the above-described A area separation or B area separation, while high voltage is being supplied by the high voltage unit for the purpose of preventing possible image disturbance by separation discharge. The transfer sheet 63 then moves to area 6 in FIG. 10 where image is fixed by an image fixing roller 6*a*, and is discharged onto the discharge tray 6*b*.

Referring to FIGS. 4, 5, 6, 7 and 8, description will be made as to the movement of the developing device 5*a*–5*d* and the sheet feeding timing for the transfer sheet 63 in the apparatus of FIG. 10.

Figure 4:
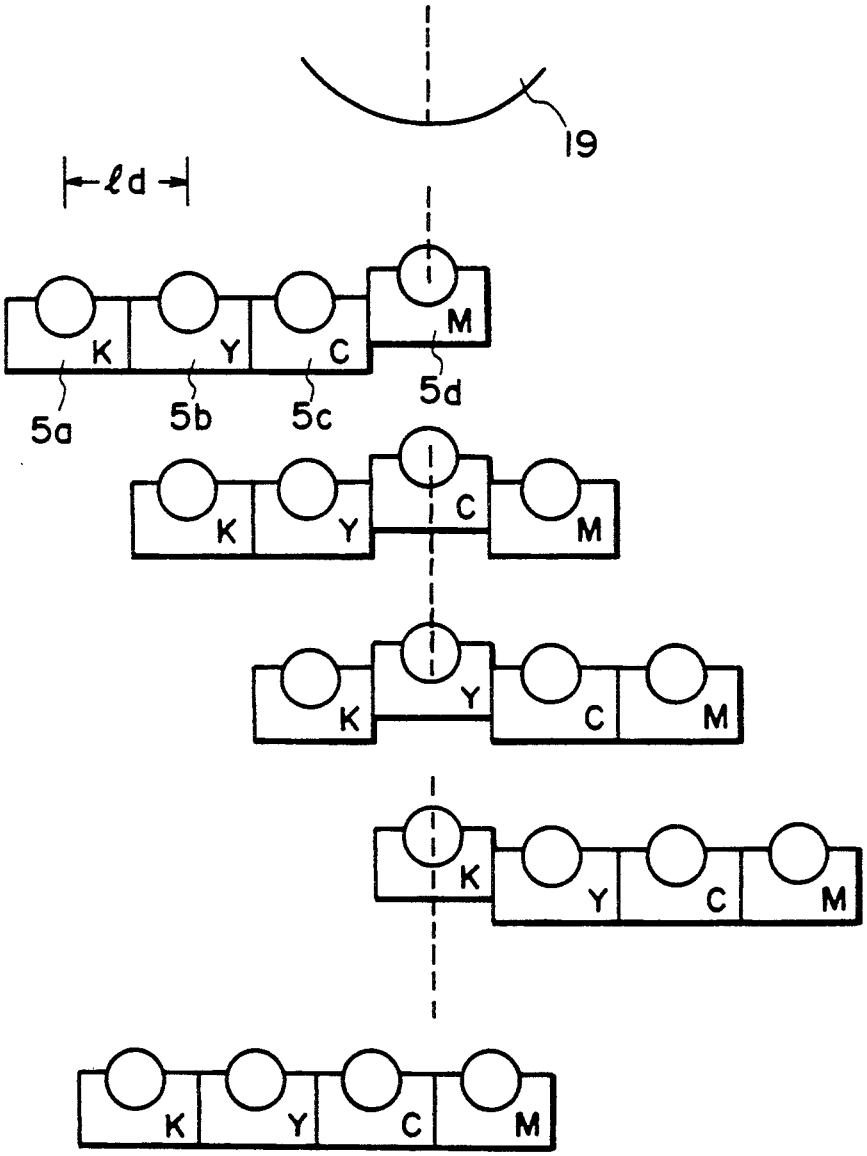
FIG. 4 is a schematic view illustrating movement of a developing device.

FIG. 4 shows various states of developing devices 5*a*–5*d* used in the apparatus of FIG. 10. As will be understood from FIG. 4, the developing devices 5*a*–5*d* are moved at a high speed so that the axes of the developing sleeves of the developing devices are aligned with the rotational axis (broken line) of the photosensitive drum 19, respectively, when the developing operation is effected from the first color to the fourth color. At the aligned position, the developing sleeve of the aligned developing device is brought in contact with the photosensitive drum 19 by an unshown lifting mechanism.

The distances between the adjacent sleeves of the developing devices 5A–5D are 1*d*.

FIGS. 5 and 6 show in cross-section attraction of the transfer sheet on the transfer drum 27*a* shown in FIG. 1. In FIG. 5, a single sheet having a maximum size is attracted, and in FIG. 6, plural sheets are attracted.

In these FIGS., $lt_1$ and $lt_2$ are sheet intervals, wherein the diameter of the transfer drum 27*a* is determined such that $lt_1 \geqq 2lt_2$ is satisfied.

Figure 7:
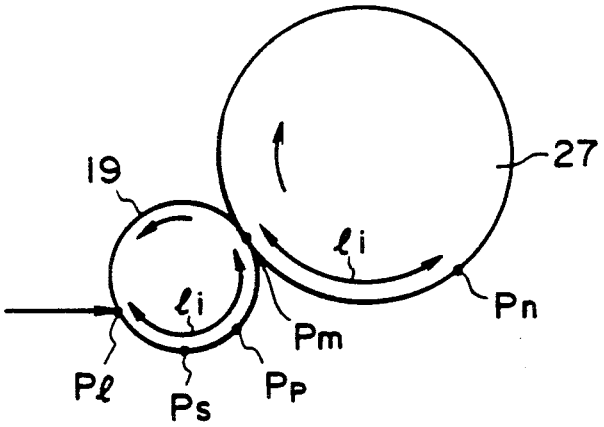
FIG. 7 is a sectional view illustrating the output timing of the image transfer timing signal.

FIG. 7 is a sectional view illustrating output timing of the image timing signal ITOP. Assuming that li is a distance from a laser writing position Pl to an image transfer position Pm and that Pn is a point li upstream from the point Pm in the rotational direction of the transfer drum, an unshown image top sensor and image top flag (light blocking plate not shown) are disposed in the transfer drum 27*a* such that the image timing signal ITOP is produced upon coincidence between PA and PB on the transfer sheet shown in FIGS. 5 and 6 with the point Pn.

Therefore, the registration roller 29 is controlled in synchronism with the image timing signal ITOP, so that the transfer sheet 63 is attracted with its leading edge at the point PA or PB.

As shown in FIG. 10, in order to present the selected one of the developing devices 5*a*-5*d* to the developing position Ps, the developing device motor is controlled such that the maximum time period TF required for movement of the developing devices (the time period required for movement between the magenta developing device to the black developing device, in this embodiment) is smaller than the difference between the time period $Tt_1$ required for the transfer drum 27*a* to move through the distance of the edge interval $lt_1$ when the usable maximum size of the transfer sheet 63 is wrapped on the transfer material carrying sheet 27 (FIG. 5) ($Tt_1 = lt_1/Vt$, where Vt is the peripheral speed of the transfer drum 27*a*) and the time period TF and the quick movement period TF for producing the toner density detection signal which will be described hereinafter ($Tt_1 - TF \geqq T1$). By doing so, the idle rotation of the transfer drum 27*a* is eliminated, so that the reversal transfer (the toner transferred to the transfer sheet 63 returns to the photosensitive drum 19) during the idle rotation can be prevented, and the reduction of the throughput can be prevented. Similarly to this control, the original scanning unit shown in FIG. 10 can effect the backward scan within the time period $Tt_1$.

Figure 8:
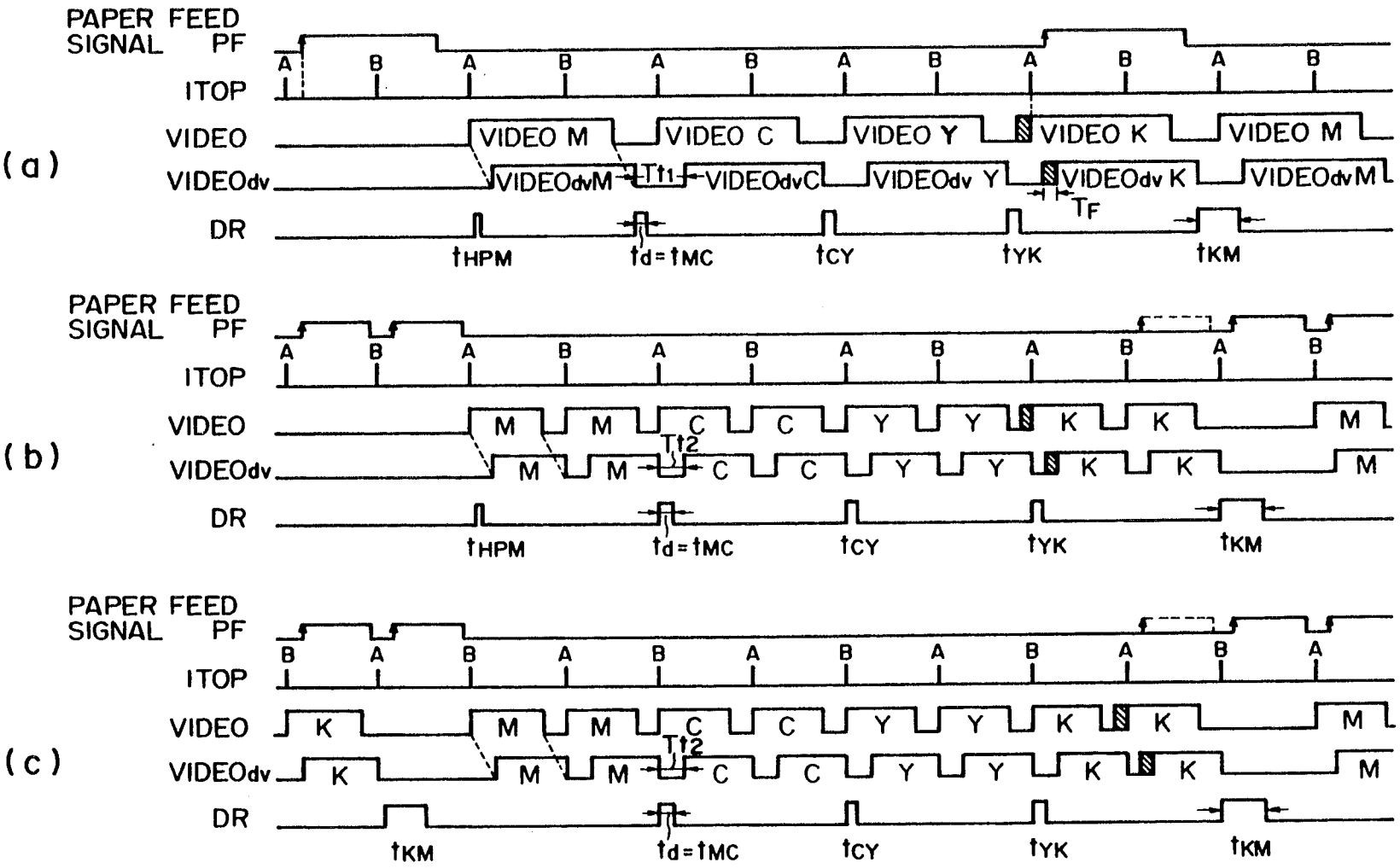
FIG. 8 is a timing chart illustrating the transfer material feeding and developing operations of the apparatus according to an embodiment of the present invention.

FIG. 8 is a timing chart for the sheet feeding operation and the developing operation. The chart (a) corresponds to when a single transfer sheet 63 is supplied, for example, A4 size sheet 63 is longitudinally fed.

The charts (b) and (c) correspond to continuous plural sheet feed, for example, A4 size sheets 63 are laterally and continuously fed. The chart (c) continues from the chart (b).

In these Figures, PF is a paper feed signal which rises a predetermined period after production of the image timing signal ITOP, and it falls after completion of the sheet feed. "A" and "B" on the ITOP signal correspond to when the points PA and PB of the transfer material carrying sheet 27 coincide with the point $P_n$ as shown in FIG. 7. "VIDEO" is an image signal, and VIDEOdv corresponds to the image signal at the point Ps in FIG. 7. Therefore, the deviation between the VIDEO signal and the VIDEOdv signal (time delay) corresponds to the time period required for the leading edge of the latent image on the photosensitive drum 19 to move from the point Pl to the point Ps, and the deviation will hereinafter be represented by TDV. In these Figures, M, C, Y and K represent color signals for the magenta color, the cyan color, the yellow color and the black color, respectively.

In FIG. 8, the hatched portions following the black image signals VIDEO and VIDEOdv, represent image portions for the toner content detection, which will be described hereinafter. An image signal with a predetermined image density is produced for the time period Tp, and the portion is developed. The image density of the resultant toner image is detected by a toner density detecting sensor 600 (FIG. 15) (toner content detecting means) disposed in the vicinity of the photosensitive drum 19. The response to the output of the sensor is used for the toner supply control from the hopper H (FIG. 3).

Reference DR designates a driving signal for the developing device. The home position of the developing device (the position where the developing device is retained when the copying operation is not performed) is such a position that the axis of the photosensitive drum 19 is aligned with the center between the magenta developing device 5*d* and the cyan developing device 5*c*. The time required for movement from the home position to the magenta developing position is designated by $t_{HPM}$. Similarly, the period required for the movement from the magenta developing position to the cyan developing position is $t_{MC}$; the time period required for the movement between the cyan developing position and the yellow developing position is $t_{CY}$; the time required for the movement between the yellow developing position and the black developing position is $t_{YK}$; and the time period required for the movement between the black developing position and the magenta developing position is $t_{KM}$. Therefore, $$\begin{aligned}(1/3)(t_{KM}) &= (1/3)t\max = td \\ &= t_{MC} = t_{CY} = t_{YK} = 2t_{HPM},\end{aligned}$$

assuming, for the sake of simplicity that the developing device moves at a constant speed.

In FIG. 8, (*a*), the developing device motor 48 is controlled so that $Tt1 > Tp$, $Tt1 \geqq t_{KM} = T$, and therefore, the color copying sequence can be continuously executed without idle rotation.

In FIG. 8, (*b*), two transfer sheets 63 are fed in response to paper feed signals PF produced in synchronism with the image timing signal ITOP which is produced sequentially by the position sensor 46 in FIG. 3. During one full turn of the transfer drum 27*a*, two developing operations are effected by the same developing device 5*d*, and the next developing device 5*c* is brought to the developing position in the time period $t_{MC} = td$ which is shorter than the time period Tt2 corresponding to the edge interval lt2 between the transfer sheets 63. Then, the developing device 5*c* performs its developing operations. Similarly, the cyan developing device 5*c* is shifted, and the yellow developing device 5*b* is brought to the developing position to effect the yellow developing operations. As regards the movement of the yellow developing device 5*b* to the black developing device 5*a*, the requirement is that $Tt2 \geqq t_{YK} + T$ and therefore, it is possible that the non-transfer region of the photosensitive drum 19 (corresponding to the connecting member 1033) is developed for the toner content detecting image thereon with the black toner after the completion of the movement, and that the read image can be developed.

However, during the next continuous sheet feeding, the time required for the movement from the black developing device 5*a* to the magenta developing device 5*d* is $Tmax = t_{MK}$, and therefore, it is not possible to satisfy $Tt1 > Tt2$. In consideration of this, where two transfer sheets 63 are fed in response to paper feed signals Ps which is produced in synchronism with the transfer timing signal ITOP next produced by the position sensor 46, and after the first one of the continuous sheets is separated from the transfer material carrying sheet 27, the idle rotation is always effected to adjust the sheet feeding timing to suppress the reduction of the throughput.

FIGS. 9A, 9B, 9C and 9D illustrate sheet feed timing in the case of plural sheets subjected to the image transfer operation, in accordance with an embodiment of the present invention. The same reference numerals as in FIG. 10 have been assigned to the corresponding elements.

Figure 9A:
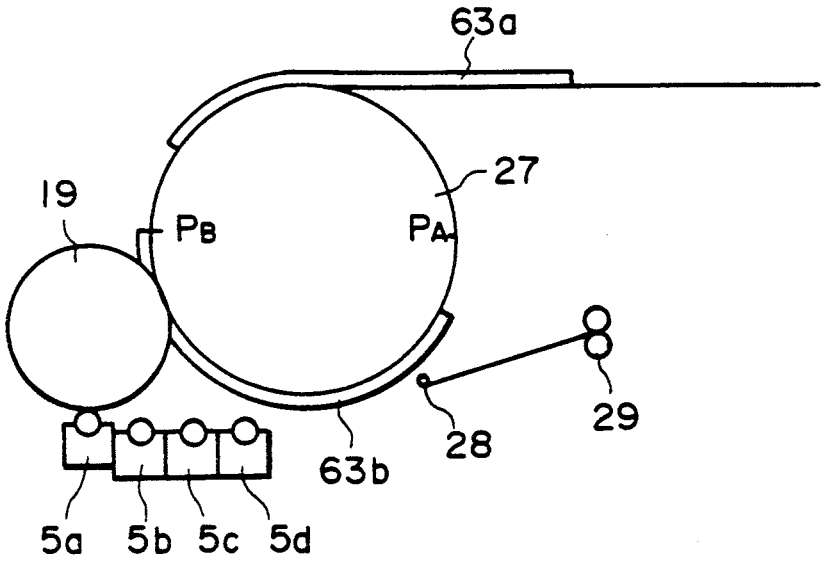
FIGS. 9A, 9B, 9C and 9D illustrate transfer material feed timing in the case of image transfer on plural sheets, according to an embodiment of the present invention.
Figure 9B:
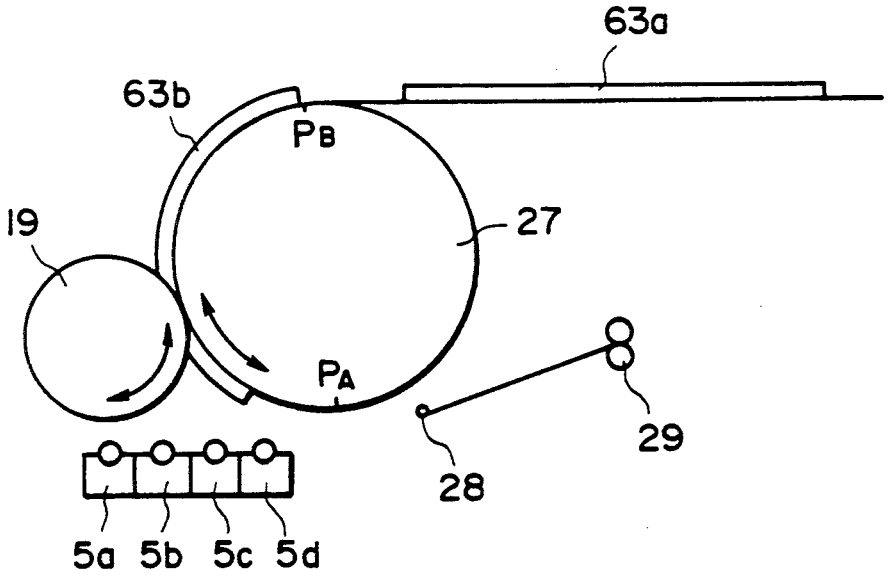
Figure 9C:
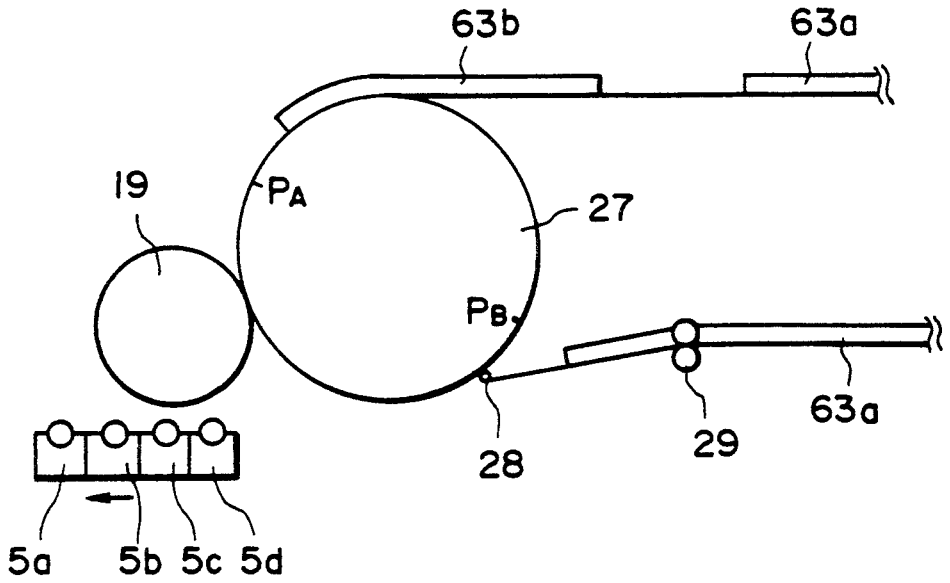
Figure 9D:
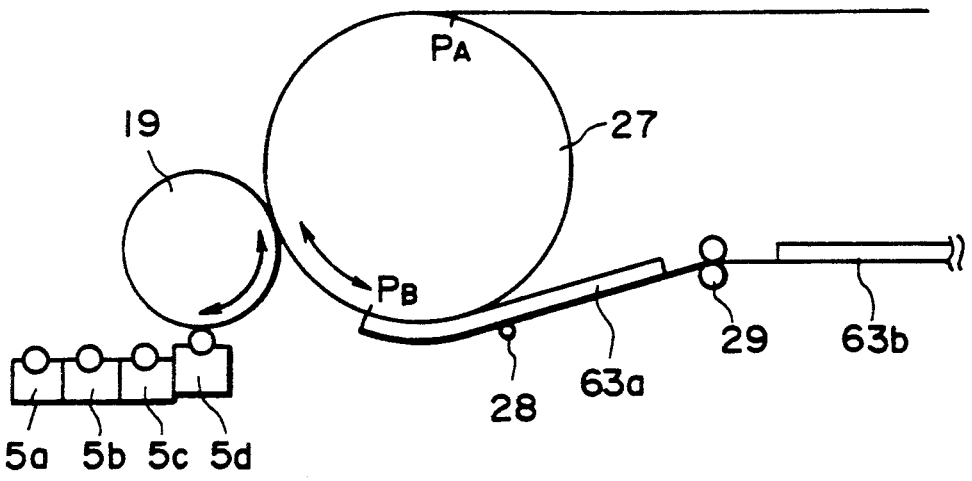

In FIG. 9A, the last image developing operation is being performed; in FIG. 9B, the first sheet has been separated; in FIG. 9C, the next transfer sheet 63 is being fed; and in FIG. 9D, the next transfer sheet 63 is attracted.

Referring to FIGS. 9A-9D, the sequential operation for the image transfer will be described where a plural sheet copy operation is performed.

As shown in FIG. 9A, the transfer sheets 63*a* and 63*b* are attracted on the transfer material carrying sheet 27 at the respective reference positions PA and PB. When the toner image formed by the developing device 5*d* is transferred from the photosensitive drum 19 onto the transfer sheet 63*b*, the transfer sheet 63*a* is first separated from the transfer material carrying sheet 27. Thereafter, the lifting mechanism for the developing device 5*a* is disabled upon completion of the developing operation corresponding to the transfer sheet 63*b*, so that it becomes movable.

Then, each of the developing devices 5*a* -5*d* is moved to the predetermined position. In order to move the developing device 5*d* (next developing device) to the axis of the photosensitive drum 19, the time of $t_{max}$ ($td \times 3$) is required, as described hereinbefore. It is longer than the time period Tt2 corresponding to the sheet intervals of the sheets retained on the transfer material carrying sheet 27. This prevents the next transfer sheet 63*a* from being attracted on the transfer position PA of the transfer material carrying sheet 27 (see the paper feed signal PF indicated by a broken line in FIG. 8, (*b*)). To solve this problem, the sheet feed timing is delayed by the time period corresponding to one half rotation of the transfer drum 27*a* so that the second transfer position PB for the transfer sheet 63*b* becomes the first transfer position for the next set of plural sheets. In FIG. 9C, the attraction roller 28 is contacted to the transfer material carrying sheet 27 to prepare for the attraction of the transfer sheet 63*a*.

Then, as shown in FIG. 9D, the next first sheet 63*a* is attracted to the transfer position Pb. By the time of the start of the attraction process for the transfer sheet 63*a*, the movement of the developing device 5*d* to the axis of the photosensitive drum 19 is completed, and the developing sleeve is contacted to the photosensitive drum 19 by the lifting mechanism.

As will be understood from the foregoing, the transfer sheet 63*a* is not attracted on the transfer position Pa at which the first one 63*a* of the plural transfer sheets has been attracted. Rather, the one half idle rotation is carried out, and the time period for the idling rotation is utilized for moving the developing devices 5*a* -5*d*. Furthermore, the sheet feeding operation is so controlled that the next first transfer sheet 63*a* can be attracted to the transfer position PB at which the second one 63*b* of the previous transfer sheets has been attracted. Thus, the next copy sequential operation can be resumed with minimum waiting period, by which the reduction of the through put can be suppressed.

Figure 12:
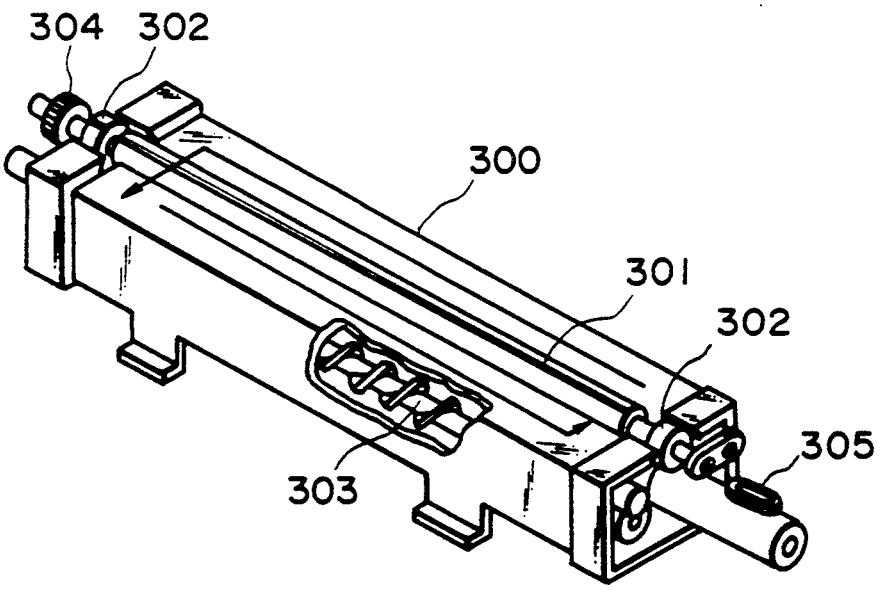
FIG. 12 is a perspective view of a developing device.

Referring to FIGS. 12, 13, 14, 15 and 16, the description will be made as to the toner content detection in each of the developing devices and as to the toner content detection using the toner image formed on the photosensitive drum 19 at such an area as to correspond to the non-contact region between the transfer material carrying sheet 27 and the photosensitive drum 19. FIG. 12 is a perspective view of one of the developing devices 5*a*, 5*b*, 5*c* and 5*d*. The other ones have the same structure. A toner hopper H for each colors is disposed above the movable carriage (not shown) of the developing device in FIG. 10. Each of the toner hoppers H is equipped with a flexible toner supply connector, so that the toner can be supplied irrespective of the position of each of the developing devices. The toner supplied from the toner hopper H is supplied to the toner supply port 305 and is circulated in the toner container 300 in the direction indicated by the arrow in FIG. 12 by two screws 303 driven by an unshown sleeve motor which gages gear 304.

With respect to the magenta developing device 5*d*, the cyan developing device 5*c* and yellow developing device 5*b*, the toner content in the developing device is optically detected.

Figure 13:
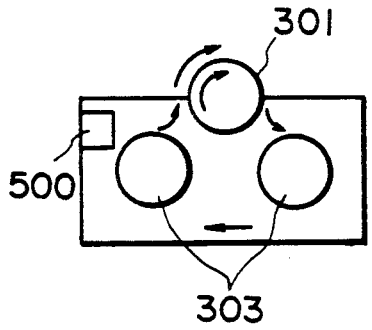
FIG. 13 is a sectional view of a developing device.
Figure 14:
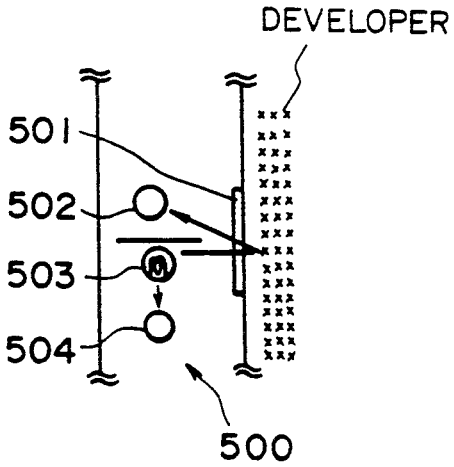
FIG. 14 shows toner content detecting method in the developing device.

FIG. 13 is a sectional view of such a developing device, comprising a developing sleeve 301 and a screw 303. The toner content detecting sensor 500 is disposed at such a position as shown in FIG. 13 to detect the toner content immediately before the developing action. The toner density detecting sensor 500 has a structure shown in FIG. 14 which is a top view of the toner content detector 500 of FIG. 13. It includes a detection window 501 made of transparent material which is coated with a material having low surface energy, such as tetrafluoroethylene at the side contactable to the developer, by which the toner and carrier particles are prevented from being deposited on the window. An automatic toner regulator lamp which will hereinafter be called ATR lamp, 503 projects light to the developer, and the light reflected thereby is received by the photoreceptor 502, by which the toner content is detected. The spectral distribution of the lamp is selected on the basis of the material of the toner. For one embodiment uses an LEF element having the wavelength component of 900-1000 nm which is reflected by resin toners. The photoreceptor 504 receives the light directly from the ATR lamp 503. By comparison with the initial level of the light from the ATR lamp 503, the correction can be made to the signal from the photoreceptor 502 on the basis of the change with time of use.

Figure 17:
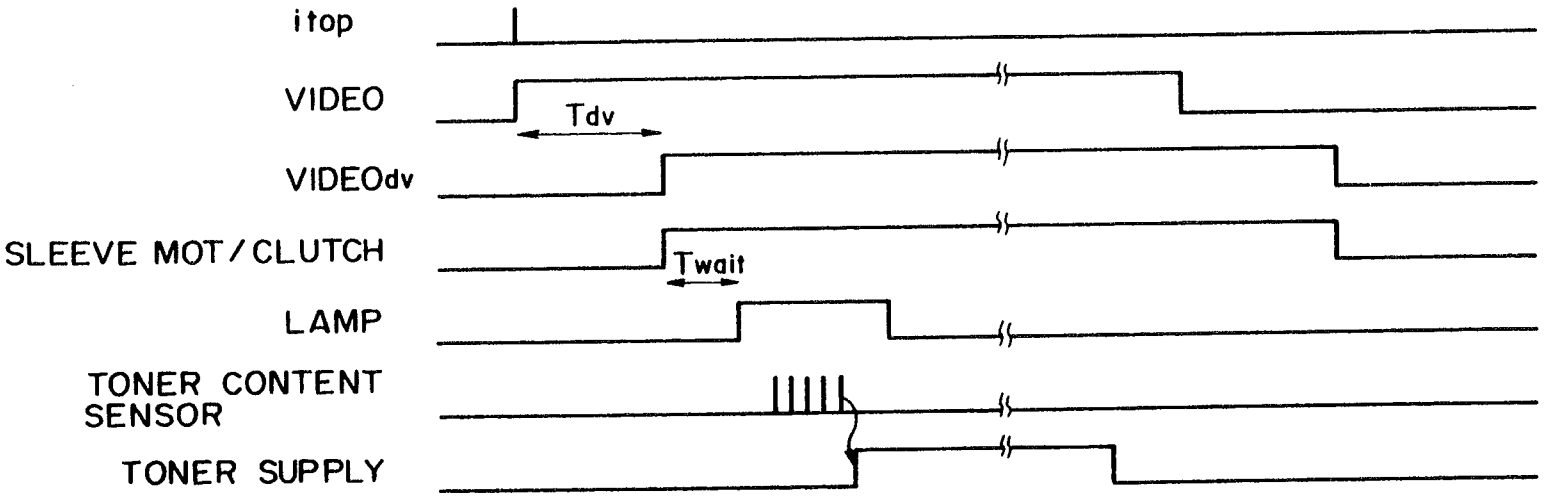
FIG. 17 is a timing chart showing the toner content detecting timing in the developing device.

FIG. 17 is a timing chart of the toner content detecting operation. In synchronism with the leading edge (VIDEOdv) signal of the electrostatic latent image at the developing position Ps, the sleeve clutch (not shown) corresponding to the developing device transmits the driving force from the sleeve motor (not shown), upon which the screw 303 rotates to perform the stirring operation in the developing device. In order to avoid the influence to the toner content by the resting period, the ATR lamp 503 is turned on after a delay (Twait), and the toner content detecting operation is carried out a plurality of times. Then, the ATR lamp 503 is turned off, and the calculation is made as to the amount of toner to be supplied, in response to which the toner supplying operation is performed. Contemporaneously, with the toner content detection and the toner supply operation, the developing operation is carried out to develop the electrostatic latent image.

Figure 15:
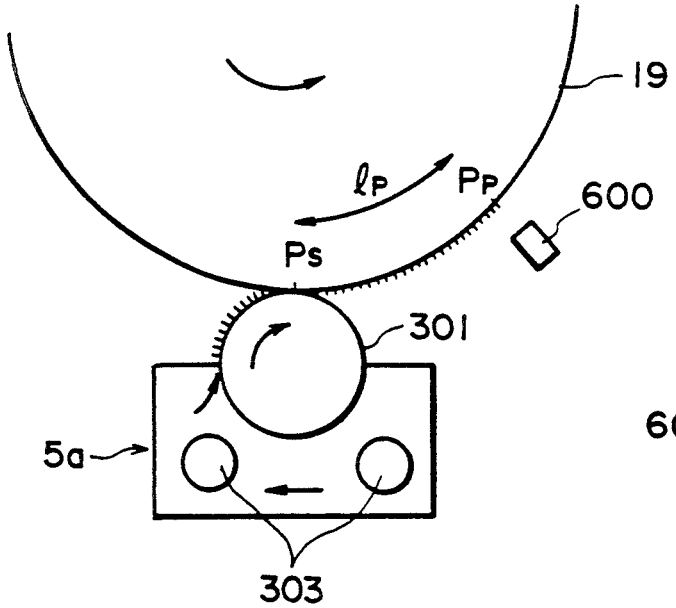
FIG. 15 is a sectional view of a photosensitive drum and toner content detecting means disposed therearound.
Figure 16:
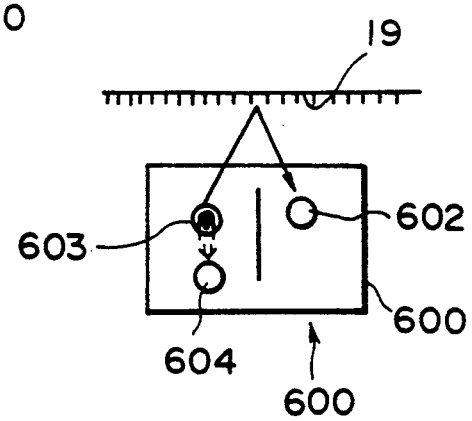
FIG. 16 is a sectional view showing details of the toner content detecting means shown in FIG. 15.

FIG. 15 shows the behavior during the development for the photosensitive drum 19 by the black developing device 5*a*. As described hereinbefore, the black toner contains carbon black, and therefore, even if it is illuminated by the toner content detecting light source, the light is all absorbed thereby. However, the photosensitive drum has an aluminum substrate, so that the toner image density can be detected by the light reflected by the aluminum substrate, and the toner content can be determined on the basis of the toner image density. The developed image is detected by a black toner density detecting sensor 600 disposed at a position faced to a point Pp which is downstream from the developing position Ps by a distance lp. The black toner density detecting sensor 600, as shown in FIG. 16, comprises a light emitting lamp 603, a direct photoreceptor 604 for directly receiving the light from the light emitting lamp 603 and a reflection photoreceptor 602 for receiving light reflected by the photosensitive drum 19 where the toner image exists Similarly to the toner content detecting sensor 500, the correction by the change with time of use can be made.

Figure 18:
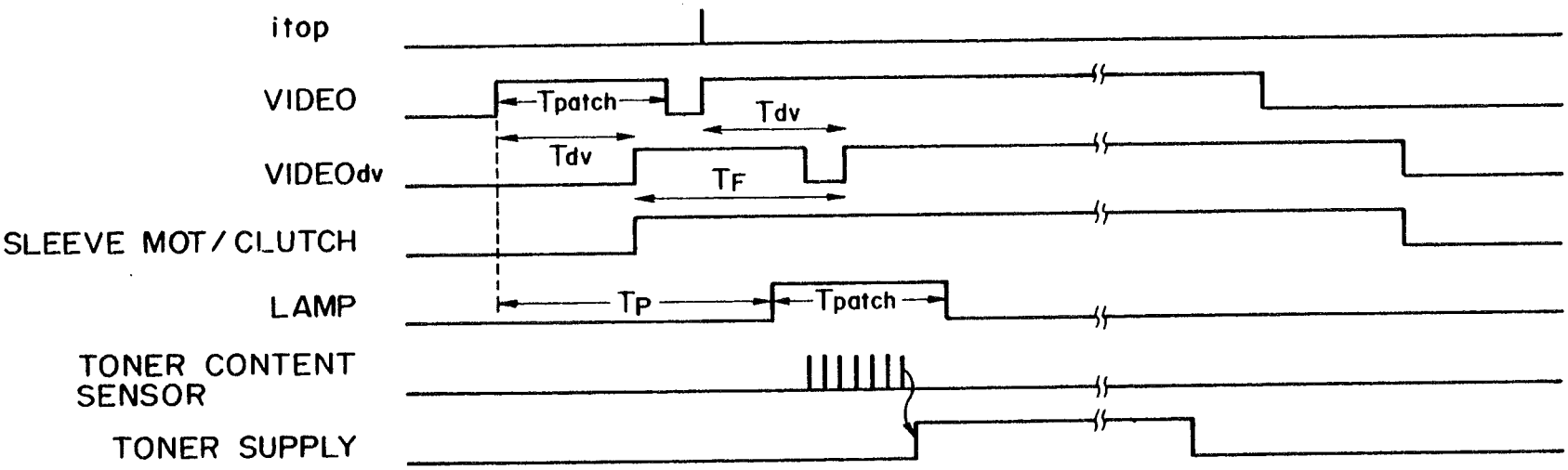
FIG. 18 is a timing chart for detecting the toner density detecting timing on the photosensitive drum.

FIG. 18 is a timing chart for the black toner content detecting operation.

In FIG. 18, Tdv is the time period required for the periphery of the photosensitive drum 19 to move from the position Pl to the position Ps in FIG. 7; Tp is the time period required from the point Pl to the point Pp in FIG. 7; Tpatch is the output time of the image for the toner content detection and is a time period required for the transfer drum to move through the width $l_{patch}$ of the connecting member 1033 in FIG. 1B (Tpatch=-$l_{patch}$/Vt (Vt is a peripheral speed of the transfer drum 27*a*)).

Even if the transfer drum 27*a* is rotated with the outer peripheries of the sleeves or rings 1031 and 1032 being contacted to the outer periphery of the photosensitive drum, the developed image being formed on the photosensitive drum 19 at the position corresponding to the connecting member 1033, the developed image does not contact to the transfer material carrying sheet 27, because the connecting member 1033 sinks by a distance ldown, as shown in FIG. 1A.

The length of the toner image for the toner content detection measured along the longitudinal direction of the photosensitive drum 19 may be as large as the size of the black toner content detecting sensor 600 in the same direction.

Thus, the toner image for the toner content detection formed at such a region of the photosensitive drum as is not contactable to the transfer material carrying sheet at the image transfer position. Such a toner image comes to the black toner content detecting sensor 600 after the time Tp. Then, the lamp 603 is turned on to perform the toner image density detection. Subsequently, the CPU 42 determines the amount of the toner to be supplied. If necessary, the toner is supplied to the developing device 5*a* from the black toner hopper. The spectral distribution of the lamp 603 is such that it provides the wavelength of 900–1000 nm is not absorbed by the photosensitive drum 19, and therefore, which does not deteriorate the photosensitive drum 19.

Referring to the flow chart of FIG. 19, the sheet feeding and the developing operations, according to the embodiment of the present invention will be described For the purpose of easy understanding, the quick movement period ($T_F$ in FIG. 18) to the black developing device 5*a* from a certain developing device to develop the toner image for the toner content detection, will be included. For example, the time period required for the movement from the yellow developing device 5*b* to the black developing device 5*d* is considered as being ($T_F+T_{YK}$). Then, the black toner content detecting operation is possible when the black developing device 5*a* is used in any developing device using mode, only if the developing device is movable. The time period required for the movement between the developing device home position to each of the developing devices upon start of the operation is not considered in the flow chart, since the movement may be started before the image forming operation. At first, a color mode (the developing device to be selected), the number of copies and the size of the transfer sheets or the like are determined from the instructions inputted in the operating panel 51 shown in FIG. 3. When an unshown start key is depressed in the operating panel (step (1)), the CPU 42 discriminates the sheet size from the sheet feeding station 2 (step (2)), and determines the developing device to be used on the basis of the color mode selected (step (3)). Then, the discrimination is made as to whether the size of the transfer sheet 63 is not more than one half the circumferential length of the transfer drum 27*a*, from the determined size of the transfer sheet 63. When it is not more than one half, the investigation is made as to whether or not the developing device is movable in the time period $t_2$ required by the sheet interval when two sheets are attracted (step (5)). For example, in the case of the four color mode in which the developing operation is performed in the order of magenta color, the cyan color, the yellow color and the black color, the comparison is made between the sheet interval period between the two sheets and the movement period $T_{MC}$ from the magenta developing device 5*d* to the cyan developing device 5*c*, the movement periods $T_{CY}$ and required for the movement from the cyan developing device 5*c* to the yellow developing device 5*d* and the movement period $T_{YK}$ required for the movement from the yellow developing device 5*b* to the black developing device 5*a* (the time period $T_{YK}$ includes the time period TF of the quick movement for the outputting of the toner content detection image). When any one of them is larger than or equal to $t_2$, the developing device can not be moved within the time period provided by the sheet interval, so that the two sheets can not be attracted. Then, the comparison is made between the time period for the movement from the last developing device to the first color developing device and the sheet interval period $T_2$ between the two sheets (step (6)).

In the case of the four color mode, the last developing device is the black developing device 5*a*, and the first developing device is the magenta developing device 5*d*. In this case, the movement period is $T_{KM}$, and is longer than the sheet interval period $t_2$ for the two sheet attraction and, therefore, two image forming operations are performed continuously, and then, one half idle rotation is performed, and thereafter, the next sheet is fed, and the image forming operation is performed.

When a blue image is to be formed using the magenta developing device 5*d* and the cyan developing device 5*c*, for example, the last developing device is the cyan developing device 5*c*, and the first developing device is the magenta developing device 5*d*. In this case, the moving period is $T_{MC}$, which is shorter than the sheet interval period $t_2$ for the two sheet attraction, and therefore, the idle rotation after the two sheet continuous image forming operation is not performed, and the sheet can be continuously fed. Accordingly, the developing operation is continuously carried out for the two sheets (steps (7) and (8) in FIG. 19B).

Figure 19A:
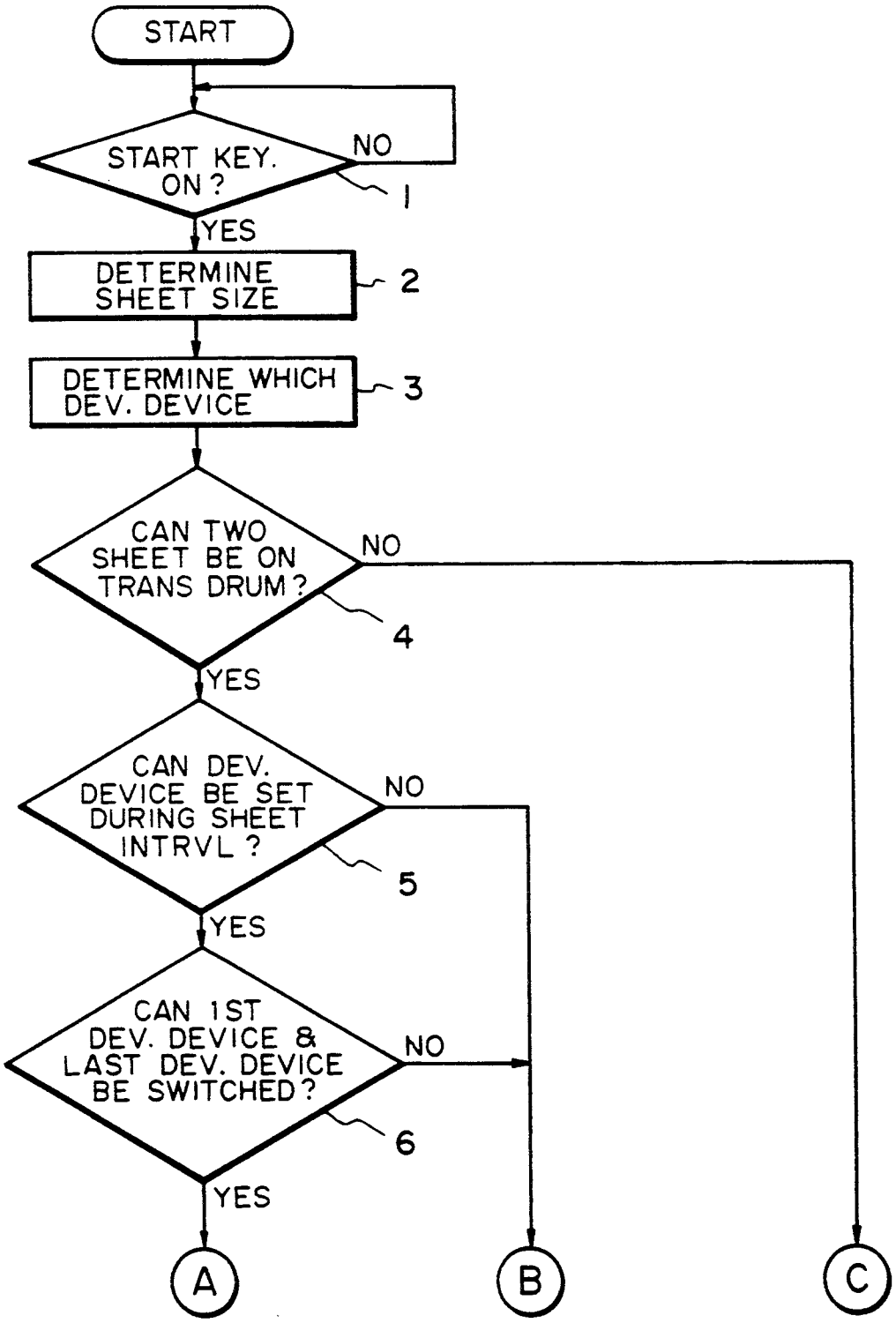
FIGS. 19A, 19B, 19C, 19D, 19E are flow charts illustrating the sequential control operation in the apparatus of the present invention.
Figure 19B:
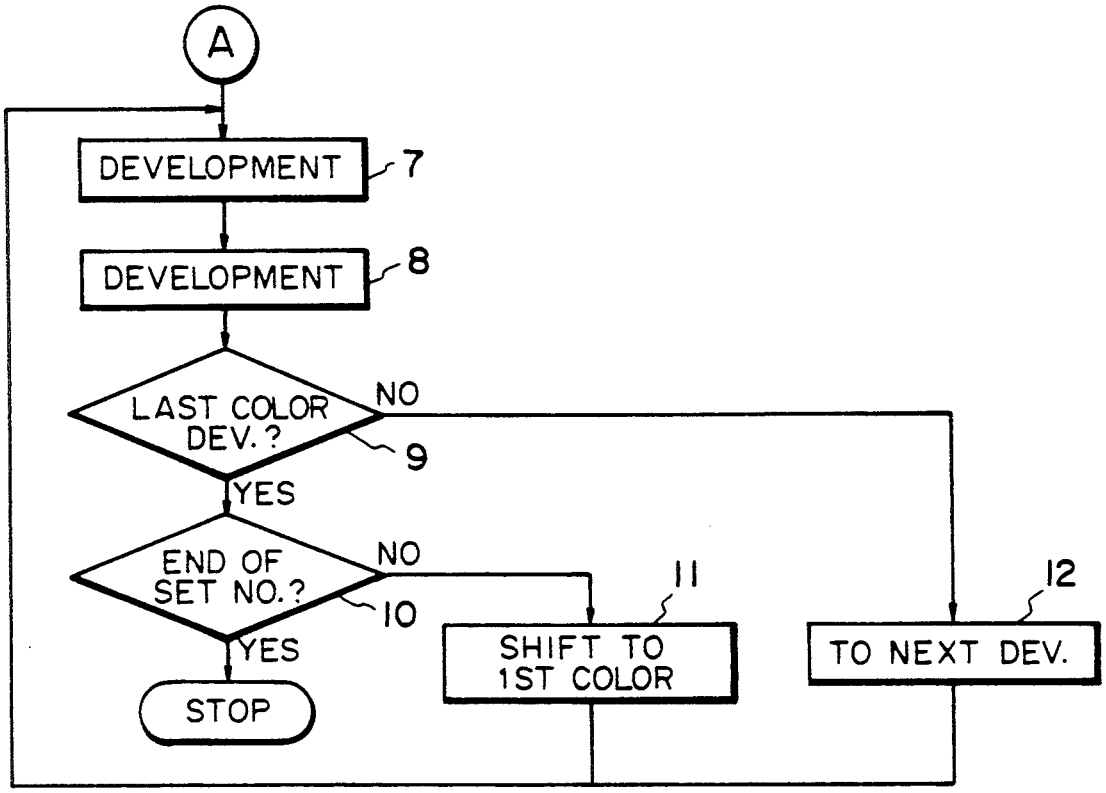
Figure 19C:
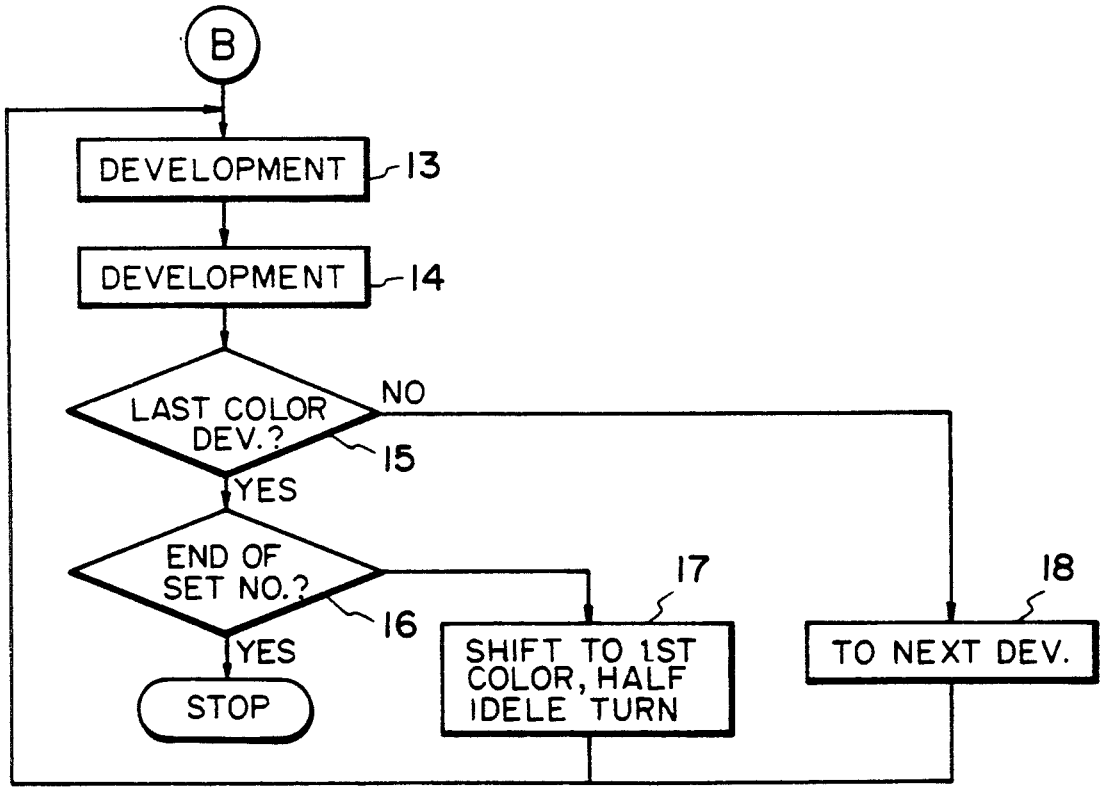
Figure 19D:
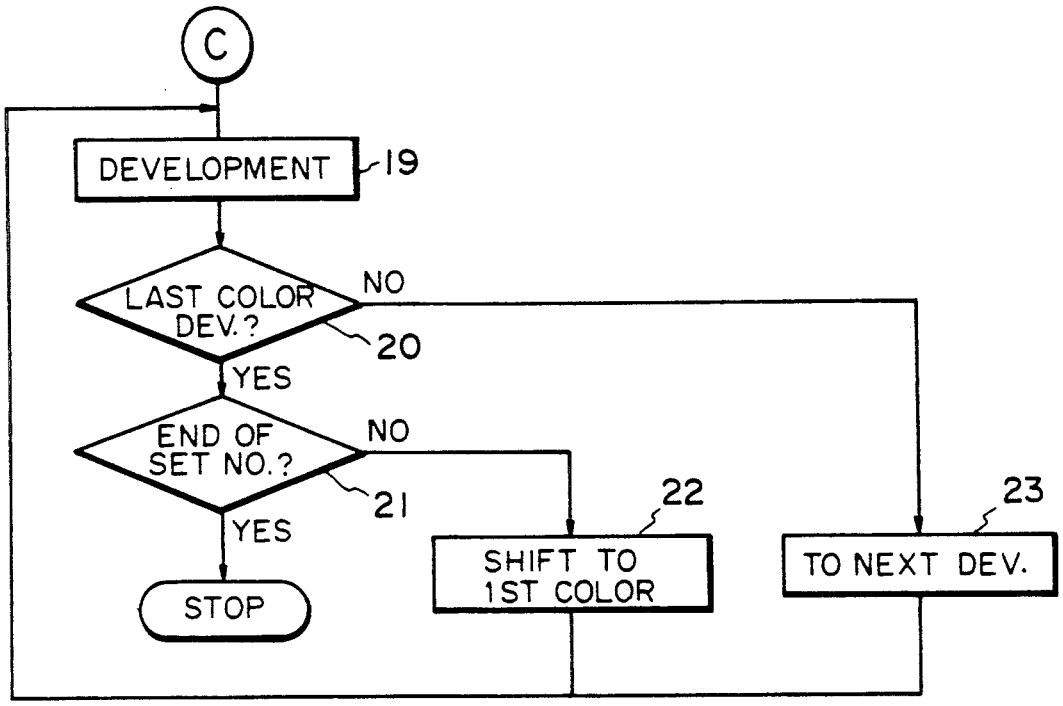
Figure 19E:
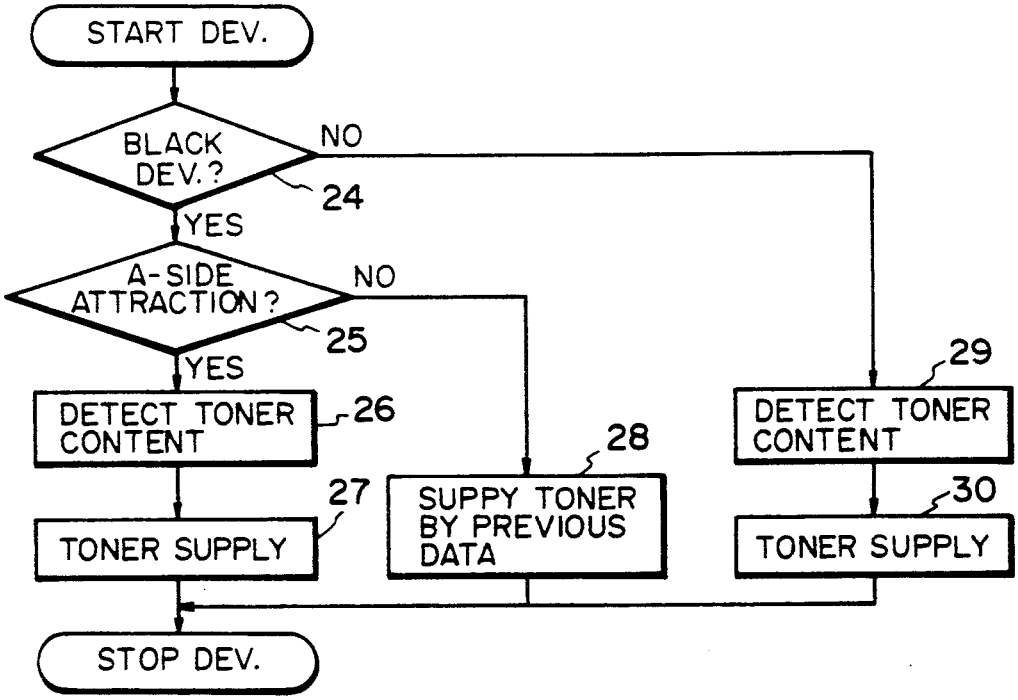

The developing operation is shown in FIG. 19E. Where the black developing device 5*a* is used (step (24)) or where the transfer sheet 63 is attracted on the A area attracting position (step (25)), a toner content detecting latent image is formed on the photosensitive drum 19, and the latent image is developed. The density of the toner image is detected by the sensor 600 (step (26)). If necessary, the toner is supplied (step (27)).

When the sheet is attracted at the B area rather than A area at step (25), the connecting member 1033 where the toner content detecting operation can be performed is not exposed, and therefore, the toner content detecting operation is not carried out. In this case, the toner supply operation is carried out on the basis of the result of the previous toner content detecting operation (step (28)). Where the magenta developing device, the cyan developing device or the yellow developing device rather than the black developing device 5*a* is used, the toner content in the developing device is detected using the toner content detecting sensor 500 during the developing operation (step 29)), and if necessary, the toner is supplied (step (30)).

After the continuous developing operation for the two sheets is completed, the discrimination is made as to whether or not the used developing device is for the last color or not (step (9)). If it is not the last color, the instructions are made to the developing device motor controller 47 to operate the next color developing device (step (12)). If it is the last color developing device, on the contrary, the discrimination is made as to whether or not the preset number of operations are completed (step (10)). If not, the operation returns to the first color (step (11)) (when the mode is such that only one developing device is used, for example, when monochromatic black mode is selected, the movement to the next developing device is not performed). After a selected number of operations are completed, the developing device carriage returns to the home position, so that the operation ends.

Where the movements between the developing devices are possible in the sheet interval period for the two sheet attraction except for the movement from the last developing device to the first developing device, as in a four color mode, the next sheet feeding operation is delayed by one half rotation, and within the delay period, the movement from the last developing device to the first developing device is effected. At this time, as described in conjunction with FIG. 19C, the continuous developing operation is performed (steps (13) and (14)). Subsequently, the discrimination is made as to whether or not it is the last color developing device (step (15)). If not, the instruction is made to the developing device motor controller 47 to operate the next developing device (step (18)). If so, the movement is instructed to the first color developer, and the above operation is repeated until the selected number of sheets are covered (step (16)). If the selected number is not completed, the one half idle rotation is carried out (step (17)).

Referring to FIG. 19D, the description will be made as to the case wherein only one transfer sheet 63 is attracted on the transfer material sheet carrying sheet 27. As contrasted to the foregoing two cases, only one developing operation is performed. In this case, the movement between any developing device is possible within the time period Tt1 corresponding to the sheet interval when a maximum size of the transfer sheet is attracted on the transfer material carrying sheet 27. Therefore, after the completion of the developing operation (step (19)), the discrimination is made as to whether or not it is the last color (step (20)). If not, the next developing device is operated (step (23)). If so, the above-operation is repeated until the selected number of copies are covered (step (21)), and the developing device is moved to the first color (step (22)). When only one developing device is used with the size of the transfer sheet for which two sheets are not attractable, as in the case of A4 size, the developing device is not required to move. The above described operation is repeated until the selected number is covered (step (21)).

In the foregoing embodiments, the image for the toner content detection is formed at such a portion of the photosensitive drum as corresponds to the connecting member 1033 of the transfer drum 27*a*. It is a possible alternative that the cut-away portion or portions (recess or recesses) 1037 shown in FIG. 1B are used as a non-contact region or regions, wherein the toner content detecting image or images are formed on the photosensitive drum 19 at a position or positions corresponding to the non-contact region or regions. If this structure is employed, the connecting member 1033 is not required to sink (ldown), so that the manufacturing cost of the transfer drum 27*a* can be decreased.

In the embodiments, the toner content of only the black toner is detected on the photosensitive drum, but it is possible that the toner content of any of the other tones can be detected on the photosensitive drum. If the toner contents of all of the toners are detected on the photosensitive drum, a minimum number of sensors is enough, and therefore, the cost can be decreased, and the structure can be simplified. An additional advantage is that the detection is made by the detector closer to the actual image, as contrasted to the case of detecting the toner content in the developing device.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for forming an image on said image bearing member, said image forming means including developing means for forming a toner image on said image bearing member;

transfer means for transferring a toner image onto a transfer material, said transfer means including movable transfer material carrying means for carrying the transfer material to an image transfer station, wherein said transfer material carrying means includes a transfer material carrying sheet for carrying the transfer material and a supporting member for supporting said transfer material carrying sheet, and which extends in a direction substantially perpendicular to a movement direction of said transfer material carrying means;

toner content detecting means for detecting toner content, said detecting means detecting toner content using the toner deposited on said image bearing member by said developing means; and control means for controlling an image forming condition in accordance with an output of said detecting means;

wherein the toner for the detection by said detecting means is deposited on a portion of said image bearing member corresponding to the supporting member.

2. An apparatus according to claim 1, wherein said control means controls the amount of toner in the toner image in accordance with the output of said detecting means.

3. An apparatus according to claim 2, wherein said control means controls the amount of toner in said developing means in accordance with an output of said detecting means.

4. An apparatus according to claim 1, wherein said transfer material carrying means has a pair of ring portions connected by said supporting member, and wherein an opening defined by said ring portions and said supporting member is covered by the transfer material carrying sheet.

5. An apparatus according to claim 1, wherein plural toner images having different colors can be formed on said image bearing member, and the plural toner images are transferred to the same transfer material.

6. An apparatus according to claim 5, wherein a full color toner image can be formed on the transfer material.

7. An apparatus according to claim 1, wherein said detecting means receives light form a light source directly or by way of the toner deposited for the detection.

8. An apparatus according to claim 7, wherein said control means controls the image forming condition on the basis of the direct light or the light reflected by the toner.

9. An apparatus according to claim 1, wherein the toner is a black toner.

10. An apparatus according to claim 9, wherein the toner comprises carbon black.

11. An image forming apparatus, comprising:

a movable image bearing member;

means for forming an image on said image bearing member, said image forming means including developing means for forming a toner image on said image bearing member;

transfer means for transferring a toner image onto a transfer material, said transfer means including transfer material carrying means for carrying the transfer material to an image transfer station, wherein said transfer material carrying means includes a pair of ring portions, a connecting portion for connecting said ring portions, said connecting portion being away from said image bearing member, and a transfer material carrying sheet stretched to cover a space defined by said ring portions and said connecting portion to carry the transfer material;

toner content detecting means for detecting a toner content using the toner deposited on said image bearing member by said developing means; and control means for controlling the toner content in said developing means in accordance with an output of said detecting means;

wherein the toner for the detection is deposited on such a portion of said image bearing member as to be opposed to said connecting portion.

12. An apparatus according to claim 11, wherein plural toner images are superposedly transferred onto the same transfer material.

13. An apparatus according to claim 11 or 12, wherein the toner image is a chromatic color toner image.

14. An apparatus according to claim 11, further comprising a separation pawl for separating the transfer material from said transfer material carrying sheet.

15. An apparatus according to claim 14, wherein said connecting portion is provided with a cut-away portion for insertion thereto of said separation pawl.

16. An apparatus according to claim 15, wherein the toner detection portion of said image bearing member corresponds to the cut-away portion of said connecting portion.

17. An apparatus according to claim 6, wherein said detecting means receives light from a light source directly or by way of the toner deposited for the detection.

18. An apparatus according to claim 17, wherein said control means controls the toner content on the basis of the direct light and the light by way of the toner.

19. An apparatus according to claim 11, wherein said toner absorbs light.

20. An apparatus according to claim 11, wherein said developing means includes plural developing devices.

21. An apparatus according to claim 20, wherein said developing device uses yellow, magenta, cyan or black toner.

22. An apparatus according to claim 21, further comprising second detecting means, provided in said developing device, for detecting the amount of yellow, cyan, and magenta toners.

23. An apparatus according to claim 11, wherein the toner is a black toner.

24. An apparatus according to claim 22, wherein said second detecting means receives light from a light source directly therefrom or by way of the toner.

25. An apparatus according to claim 24, wherein said control means controls the toner content using the direct light and the light by way of the toner.

26. An apparatus according to claim 12, wherein said transfer material carrying means is capable of simultaneously supporting a first transfer material and a second transfer material.

27. An apparatus according to claim 26, wherein the first transfer material is supported downstream of said connecting portion, and the second transfer material is supported downstream of the first transfer material, with respect to a movement direction of said transfer material carrying means.

28. An apparatus according to claim 27, wherein the toner content control for the second transfer material is effected on the basis of the toner content detection for the first transfer material.

29. An image forming apparatus, comprising:

a movable image bearing member;

means for forming an image on said image bearing member, said image forming means including developing means for forming a toner image on said image bearing member;

transfer means for transferring a toner image onto a transfer material, said transfer means including transfer material carrying means for carrying the transfer material to an image transfer station, said transfer material carrying means including a pair of ring portions and a connecting portion connecting the ring portions, said connecting portion being away from said image bearing member and being provided with a recess;

toner content detecting means from detecting a toner content using the toner deposited on said image bearing member by said developing means; and toner content control means for controlling the toner content in said developing device;

wherein the toner for the detection is deposited on such a portion of said image bearing member as to be faced to the recess of said connecting portion.

30. An apparatus according to claim 29, wherein said transfer material carrying means further includes a transfer material carrying sheet covering an opening defined by said ring portions and the connecting member.

31. An apparatus according to claim 30, further comprising a separating pawl for separating the transfer material from said transfer material carrying sheet.

32. An apparatus according to claim 31, wherein said connecting portion is provided with a cut-away portion for receiving said separating pawl.

33. An apparatus according to claim 32, wherein the recess functions as the cut-away portion.

34. An image forming apparatus, comprising:

a movable image bearing member;

means for forming an image on said image bearing member, said image forming means including developing means for forming a toner image on said image bearing member;

transfer means for transferring a toner image onto a transfer material, said transfer means including movable transfer material carrying means for carrying the transfer material to an image transfer station, said transfer material carrying means being provided with a recess;

toner content detecting means for detecting toner content, said detecting means detecting toner content using the toner deposited on said image bearing member by said developing means; and control means for controlling an image forming condition in accordance with an output of said detecting means;

wherein the toner for the detection is deposited on such a portion of said image bearing member as to be faced to the recess.

35. An apparatus according to claim 34, wherein said control means controls the amount of toner in the toner image in accordance with the output of said detecting means.

36. An apparatus according to claim 35, wherein said control means controls the amount of toner in said developing means in accordance with an output of said detecting means.

37. An apparatus according to claim 34, wherein said transfer material carrying means includes a transfer material carrying sheet for carrying the transfer material and a supporting member for supporting said transfer material carrying sheet and which extends in a direction substantially perpendicular to a movement direction of said transfer material carrying means, said supporting member having said recess.

38. An apparatus according to claim 37, wherein said transfer material carrying means has a pair of ring portions connected by said supporting member, and wherein an opening defined by said ring portions and said supporting member is covered by said transfer material carrying sheet.

39. An apparatus according to claim 34, wherein plural toner images having different colors can be formed on said image bearing member, and the plural toner images are transferred to the same transfer material.

40. An apparatus according to claim 39, wherein a full color toner image can be formed on the transfer material.

41. An apparatus according to claim 34, wherein said detecting means receives light from a light source directly or by way of the toner deposited for the detection.

42. An apparatus according to claim 41, wherein said control means controls the image forming condition on the basis of the direct light or the light reflected by the toner.

43. An apparatus according to claim 34, wherein the toner is a black toner.

44. An apparatus according to claim 43, wherein the toner comprises carbon black.

45. An apparatus according to claim 34, further comprising a separation pawl for separating the transfer material from said transfer material carrying sheet.

46. An apparatus according to claim 45, wherein the recess is in the form of a cut-away portion for receiving said pawl.

* * * * *

UNITED STATES PATENT AND TRADEMARK OFFICE

CERTIFICATE OF CORRECTION

PATENT NO. : 5,121,163

DATED : June 9, 1992

INVENTOR(S) : MASANORI MURAMATSU ET AL.

It is certified that error appears in the above-identified patent and that said Letters Patent is hereby corrected as shown below: On title page,

AT [56] REFERENCES CITED

Foreign Patent Documents, "0136065 6/1968 Japan"
should read --0136065 6/1988 Japan--.

COLUMN 3

Line 40, "a separation" should read
--a separation pawl 26, a--.

COLUMN 4

Line 35, "1036b" should read --1036b.--.
Line 45, "mounted b" should read --mounted by--.

COLUMN 6

Line 23, "charged," should read --charged--.
Line 24, "charger" should read --charger,--.

COLUMN 7

Line 19, "TF" should read --T1--.

COLUMN 9

Line 52, "Pb." should read --PB.--.
Line 59, "Pa" should read --PA--.

UNITED STATES PATENT AND TRADEMARK OFFICE

CERTIFICATE OF CORRECTION

PATENT NO. : 5,121,163

DATED : June 9, 1992

INVENTOR(S) : MASANORI MURAMATSU ET AL.

It is certified that error appears in the above-identified patent and that said Letters Patent is hereby corrected as shown below:

COLUMN 10

Line 12, "colors" should read --color--.
Line 20, "arrow" should read --arrows--.
Line 22, "gages" should read --engages--.
Line 45, "For" should read --For example,--.

COLUMN 11

Line 22, "exists" should read --exists.--.
Line 67, "described" should read --described.--.

COLUMN 12

Line 39, "and" should be deleted.

COLUMN 13

Line 67, "sheet" (first occurrence) should be deleted.

COLUMN 14

Line 34, "tones" should read --toners--.

UNITED STATES PATENT AND TRADEMARK OFFICE

CERTIFICATE OF CORRECTION

PATENT NO. : 5,121,163

DATED : June 9, 1992

INVENTOR(S) : MASANORI MURAMATSU ET AL.

It is certified that error appears in the above-identified patent and that said Letters Patent is hereby corrected as shown below:

COLUMN 17

Line 18, "mem-" should read --portion.--.
Line 19, "ber." should be deleted.

Signed and Sealed this

Sixteenth Day of November, 1993

Bruce Lehman

*Attest:*

BRUCE LEHMAN

*Attesting Officer*

*Commissioner of Patents and Trademarks*